US005150093A

United States Patent [19]

Gurevich

[11] Patent Number: 5,150,093

[45] Date of Patent: Sep. 22, 1992

[54] TIME DELAY FUSE FOR MOTOR STARTER PROTECTION

[75] Inventor: Leon Gurevich, St. Louis, Mo.

[73] Assignee: Cooper Industries, Inc., Houston, Tex.

[21] Appl. No.: 711,769

[22] Filed: Jun. 7, 1991

[51] Int. Cl.[5] ..... H01H 85/04

[52] U.S. Cl. ..... 337/163; 337/164; 337/166

[58] Field of Search ..... 337/163, 164, 165, 166

[56] References Cited

U.S. PATENT DOCUMENTS 4,994,779 2/1991 Douglass ..... 337/163

*Primary Examiner*—Harold Broome

*Attorney, Agent, or Firm*—Nelson A. Blish; Alan R. Thiele; Hubert Elliot Cox

[57] ABSTRACT

A time-delay fuse having a fuse element with a series of weak spots surrounded by a loose sand filler. The fuse element is connected to a trigger mechanism by solder or other meltable alloy. The trigger section provides overload protection and the fuse element provides short circuit protection resulting in a time-delay fuse which can be used in places where there are size restrictions.

15 Claims, 1 Drawing Sheet

TIME DELAY FUSE FOR MOTOR STARTER PROTECTION

BACKGROUND OF THE INVENTION

This invention relates to fuses in general and in particular to an electric time delay fuse. A time-delay fuse is a type of fuse that has a built in delay that allows temporary and harmless inrush currents to pass without opening, yet is designed to open on sustained overloads and short circuits.

Underwriter's Laboratories has developed basic physical specifications and electrical performance requirements for fuses with voltage ratings of 600 volts or less. These requirements are known as UL Standards. If a type of fuse meets the requirements of a standard, it will be placed in that UL Class. Typical UL Classes are K-1,K-5, RK-1, RK-5, G, L, H, T, CC, and J.

Those UL classes which are labeled as "current limiting", have physical rejection features and are not interchangeable with other classes. The UL specification for Class J fuses having time delay requires the fuse to be fast clearing and tolerate a 500% overload for 10 seconds. In addition, in order for a fuse to meet the Class J requirements, it must meet the voltage, current characteristics, and physical size requirements of Underwriter's Laboratories. Thus the time-delay element and the short circuit element must be small and compact. Further, it is necessary to have a fuse which has a high interrupting rating and is fast acting during short circuit interruptions.

The objective of the class J time delay fuse for motor protection is twofold: a) to provide faster interruption during short circuit than other classes of motor protection fuses; and b) to withstand normal motor start up without nuisance opening. To achieve both of these requirements, designers must solve the problem of the common fuse link behavior. That is, an inability of a fast clearing fuse to tolerate 500% overload for 10 seconds.

Many fuse designs have only one element. This element typically consists of a single strip of material called a fuse element. During a short circuit condition, the fuse element is violently heated to a point where a section of the strip melts and disintegrates. It is the disintegration of the fuse element which interrupts the electric circuit.

Single-element fuses are not satisfactory for situations where momentary overload conditions are common. In order for the fuse to clear quickly, the fuse elements are constructed to melt immediately upon high current events. Although this is desirable for short circuit conditions, a modest overload over a short period of time often causes the fuse element to melt and interrupt the circuit.

To overcome this problem, some prior designs employed a thicker fuse element. Although this eliminated nuisance overload interruptions, it also made the fuse element more resistant to fast interruption during short circuit events, thereby increasing the damage to expensive equipment. This characteristic makes single-element designs undesirable for motor starting protection where momentary overloads are typical during the starting process.

Many of the problems of the motor starter fuse protection are solved by employing a dual-element fuse design. The dual-element fuse contains two distinctly separate elements which are electrically connected in series. The first element, called the overload element, will interrupt the circuit when the current is five times higher than the fuse rating for more than 10 seconds. The second element is called the short circuit element. It interrupts the circuit during short circuit events.

The overload element normally consists of a trigger mechanism. Although the trigger mechanism is adequate for overload situations, it does not clear quickly during a short circuit event—a requirement for good fuse performance. In order to have a fast clearing fuse, designers are encouraged to employ fast acting fuse elements in their designs. Thus the problem of nuisance interruption due to overload conditions still exists. However, the use of dual-element fuse obviates the designers dilemma of striking a good balance between overload and short circuit performance. Instead, fuse element designers may concentrate on methods to ensure fast clearing without the need to oversize the fuse element to survive an overload condition.

For short circuit interruption, some prior art devices relied on a trigger operation inside a loose sand matrix. This design was desirable because a loose sand filler is less expensive and easier to manufacture. However, the performance of this combination proved inadequate.

A second solution uses a fuse element surrounded by a better thermoconductive filler than loose sand. This alternate filler is called "stone sand," although there are other combinations of solid filler material besides stone sand. In all cases, the advantage of the solid filler is the increased thermoconductivity of the solid media surrounding the fuse element. By transferring heat to the solid filler, the fuse element is able to pass a 500% overload current longer before melting.

Although useful, the solid filler method does have drawbacks. The process of filling and solidification around the weak spots is difficult and expensive. Further, unless the filling process is taken with care, bubbles or gaps may appear near the fuse elements, thereby degrading performance.

Loose sand fillers are easier to place around fuse elements than solid fillers. However, because of the inherent gaps in the loose sand filler surrounding the fuse element, the loose sand filler cannot take absorb the heat generated within the fuse element during an overload condition.

A third solution to nuisance interruptions in fuse elements is the inclusion of low resistance weak spots in the fuse element. The heat generated by the short circuit event is concentrated at the weak spot, causing the fuse element to melt at that point. The dimension of the weak spot is chosen to provide fast clearing short circuit performance. The larger segments of the fuse element are available to absorb the heat generated during an overload condition. This means that the fuse element is, in effect, oversized for overload conditions while maintaining sort circuit performance. This method makes the use of expensive solid fillers unnecessary for some, but not all, applications.

In prior art designs, the weak spot is produced by a conventional stamping process. This technique relies on the widely accepted maxim that the minimum size of the weak spot is directly related to the minimum size of the punch used to produce the weak spot dimensions. Commonly, the limit for weak spot effective length is more than 0.018 inches. This length limit of the weak spot is proportional to the weak spot electrical resistance for a given cross section of the fuse element and is expressed by the following formula:

$$R_{W.S.} = p\frac{L_{W.S.}}{A_{W.S.}}$$

Where:

$R_{W.S.}$ = Resistance of the weak spot.

p = Resistivity of the material of the fuse element.

$A_{W.S.}$ = Cross-sectional area of the weak spot.

$L_{W.S.}$ = Effective length of the weak spot.

The value of p is constant for a given material, such as silver. The value of A is set by the limits for the $I^2t$ values for Class J fuses and the stamping process limitations. It has been known that $I^2t$ and IPEAK values can be controlled by the size of the cross sectional area of the weak spot.

For example, the cross sectional area $A_{W.S.}$ for the silver fuse element used in Class J fuses rated at 30 ampere must be smaller than 200 square mils. Thus, the cross sectional area $A_{W.S.}$ has to be smaller than some critical maximum in order to meet the requirement of UL for Class J fuses. Thus p and $A_{W.S.}$ may be taken as constants, which means that $R_{W.S.}$ must be proportional to $L_{W.S.}$. In order to employ a loose sand filler and still withstand a 500% overload for more than 10 seconds required of a Class J fuse, the resistance of the weak spot must be reduced further than in prior art designs.

It is commonly known that weak spots in series can be utilized to improve performance of the fuse at a higher rated voltage. However, the maximum number of serial weak spots which may be placed along the fuse element is limited by several factors:

1. The distance between the weak spots must be greater than two arc lengths. One arc length being the maximum distance which a given fuse element will allow conduction of electricity through the arc generated during a short circuit event as the fuse element melts. Two arcs sufficiently close to one another will continue to conduct electricity. Therefore, it is important that a series of arcs not form, and allow the circuit to remain unbroken during a short circuit event;
2. The total length of the fuse element which is normally set by the size limitation of the fuse; and
3. The total resistance of the fuse element, which, if exceeded, may cause a reduction of the carrying capacity of the fuse or cause unacceptably high temperature during the 110% carrying test.

There is therefore a need in the art for a Class J rated fuse which can utilize a loose sand filler around the fuse element.

SUMMARY OF THE INVENTION

In the present invention, the short-circuit or fusible element is comprised of a single fuse strip surrounded by a loose sand filler. A series of weak spots in the fuse element are formed by placing a series of holes in the fuse element. A reduction of the resistance of the weak spot has been accomplished by reducing the length of the weak spot ($L_{W.S.}$) from 0.018 inches to 0.013 inches. This reduction of effective length of each weak spot is accomplished by using carbide dies in the stamping process or a photochemical etching. The reduction of effective length of the weak spots allows the fuse element to withstand a 500% overload for more than 10 seconds. These allows the present invention to satisfy the UL requirements for maximum allowable $I^2t$ for a Class J time-delay fuse while employing a loose sand filler.

Because the resistance of the weak spot is directly proportional to the effective length of the weak spot, lowering the effective length of the weak spot also lowers the resistance of that weak spot. This allows more weak spots to be placed along a fuse element without an increase in resistance of that fuse element.

Another feature of the present invention is the construction of the fuse element so that a longer fuse element can be within the confines of a given fuse tube. A longer fuse element allows more weak spots in series to be placed along the fuse element and also increases the amount of material to absorb heat from the weak spots during an overload condition. The fuse element is bent approximately 90 degrees in alternating directions to form a zig-zag pattern. These bends are placed between the weak spots. Bends of a less acute angle near the respective ends of the fuse element allow the ends of the fuse elements to connect with the appropriate conducting surface at a practical angle.

The number of weak spots has been increased to eight on the present invention. The number of weak spots required for a given fuse rating is given by the formula:

$$n \geqq \frac{V_{rms\ rated}}{100}$$

Where:

n = number of weak spots.

V = Voltage. Thus, in order to satisfy the UL Class J requirement of 600 volts (rms), the number of weak spots must exceed six. It is the combination of the number of weak spots in excess of six, the shorter effective length of each weak spot, and bending of the fuse element to allow a longer fuse element within a tube that the fuse to perform up to UL Class J standards.

The second element of the present invention is the overload section. In the overload section, a heater strip is connected to a trigger assembly. During an overload condition, a fusible alloy melts, allowing a spring to separate the trigger from its electrical connection, thereby interrupting the circuit.

DETAILED DESCRIPTION OF THE INVENTION

Figure 1:
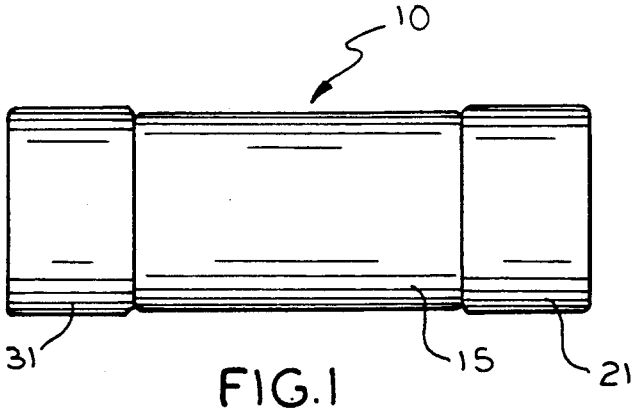
FIG. 1 shows a side view of the present invention.
Figure 2:
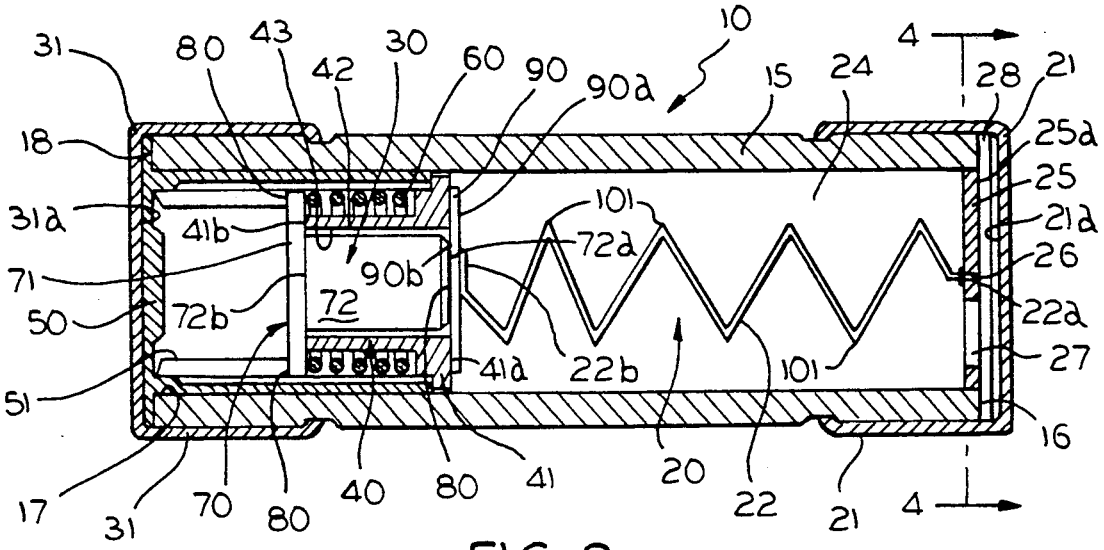
FIG. 2 shows a cross sectional side view of an embodiment of the invention.

Referring to FIG. 1 there is shown a fuse 10, having a high interrupting capacity, quick opening response for short circuits and incorporating a time-delay overload feature. The endcaps 21 and 31 connect the fuse to 10 outside electrical connections. Internal components of the fuse 10 are encased by tube 15. The two main components of the fuse 10, shown in FIG. 2, are the short circuit section 20, and the over load section 30.

The short circuit section is comprised of a fuse element 22 formed in a flat strip. Fuse element 22 shown in FIG. 3 has holes 23 which provide weak spots 100 in fuse element 22. The number of weak spots 100 must be greater than the product of the voltage rating (rms) and 0.01. Further, the spacing between the weak spots 100 must be sufficient to prevent communication of the arcs formed during the short circuit event. The holes 23 are constructed and arranged to give each weak spot 100 an effective length of approximately equal to or less than 0.013 inches.

A series of bends 101 are placed along the length of the fuse element 22, between the weak spots 100. Use of bends 101 allow a longer fuse element 22 to fit within the confines of the tube 15. Another benefit of a longer fuse element 22 is the increased number of weak spots 100 which may be along the fuse element 22. A longer fuse element 22 also results in more material to absorb heat from the weak spots 100 during an overload condition. A longer fuse element 22 also allows more heat to be transferred from the fuse element 22 to the loose sand filler 24. It is important that the heat generated by normal or nominal overload conditions be transferred away from the weak spots 100 in order to prevent unwanted circuit interruption at low overloads typical of the start up of motor operation.

The bends 101 are approximately 90 degrees and are alternated to form a zig-zag pattern. The bends 101 are made between the weak spots 100. Bends 101, generally, should not be made at the weak spots 100 because the absolute length of the weak spot 100 would be shortened an amount equal to the product of the original unbended length and the sine of the bend angle. This would allow an arc to last longer during a short circuit event and thereby degrade the performance of the fuse 10.

In a short circuit situation, the current passing through the fuse 10 is high enough to melt through the weak spots 100 in element 22 thus interrupting current through the fuse 10. By using the weak spot design for the fuse element 22 of the present invention, a loose sand filler 24, as shown in FIG. 2, can be employed to accomplish fast and reliable clearing of the fuse 10 during a short circuit event.

The short circuit section of the fuse 10 is sealed by an end washer 25. This end washer 25 may be used to confine the short circuit section. An aperture 26, as shown in FIG. 4, is necessary to allow a portion of the fuse element 22 to protrude through the end washer 25 to allow the fuse element 22 to be electrically connected to the endcap 21.

Figure 4:
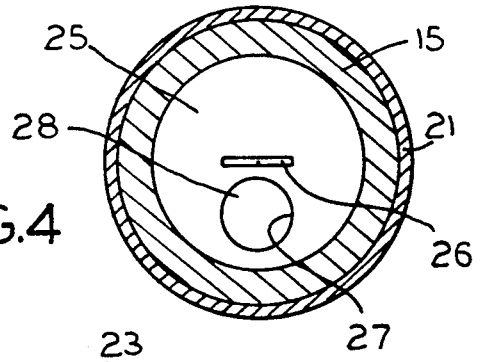
FIG. 4 shows an end view, along lines 4-4 of the present invention.

A filler 24, such as stone sand or quartz sand, is added to the fuse 10 through an opening 27 in the end washer 25 as shown in FIG. 4. After addition of the filler 24, a cap washer 28 is attached to the end 16 of the tube 15 to cover the opening 27. The endcap 21 is then fitted onto the end 16 of tube 15 and placed in contact with the cap washer 28 as shown in FIG. 2. In this embodiment, the cap washer 28 must be capable of conducting electricity. In an alternate embodiment of the invention, the endcap 21 is placed directly over the end washer 25, covering the opening 27 and establishing electrical contact with the fuse element 22.

FIG. 2 shows the overload section 30 separated from the short circuit section 20 by a spacer 40. A heater strip 50 is positioned along the inner surface 17 and end 18 of tube 15 as shown in FIG. 2. A spring 60 is placed around the body 42 of the spacer 40. The body 42 of the spacer 40 has a hollow center 43. The trigger body 72 is fitted through the hollow center 43. The spring 60 is then compressed between the spacer head 41 and the trigger head 71. The trigger 70 is held in place by bonding the trigger head 71 to the flanges 51 of the heater strip 50 with the fusible alloy 80.

The flanges 51 of the heater strip 50 are shaped to guide the trigger head 71 during opening of the trigger 70 by the spring 60. The heater strip 50 is preformed to provide positive pressure on the trigger head 71, thereby eliminating the possibility of arcing between the heater strip 50 and the trigger 70.

The fusible alloy 80 is also used to attach the trigger body 72 to the connecting washer 90. The washer 90 is also connected to fuse element 22, and makes a series connection between the over load section 30 and the short circuit section 20. An endcap 31 is placed over the end 18 of tube 15 and attached the heater strip 50 to complete the circuit.

The fusible alloy 80 must be capable of conducting electricity. In the present invention the alloy 80 comprises a mixture of 42% tin and 58% bismuth. This ratio of tin to bismuth gives the alloy 80 a melting temperature of 138 degrees Celsius. The melting temperature desired is a function of the overload current which fuse 10 must be capable of withstanding. An overload condition of sufficient magnitude will melt or weaken the alloy 80 which bonds the trigger 70 to the flange 51, thus allowing the spring 60 to force the trigger 70 to separate from the washer 90, interrupting the current passing through the fuse 10. The melting temperature may be changed by employing a different alloy.

Figure 3:
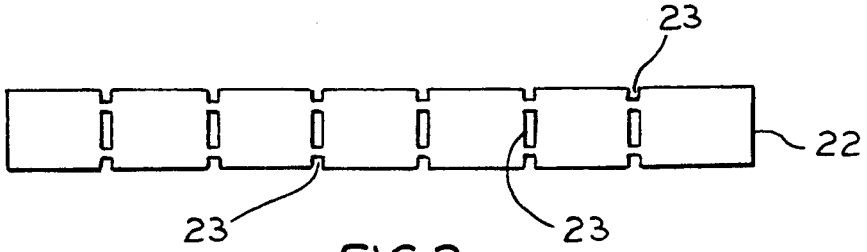
FIG. 3 shows a plan view of the fusible element of the present invention.

To summarize, the fuse as illustrated in FIGS. 2–4 has a hollow tube 15 having an inner surface 17 and a tube proximal end 16 and a tube distal end 18. The distal endcap 31 covers the tube distal end 18 and the distal endcap 31 has a distal end cap inner surface **31*a*. The proximal endcap 21 covers the tube proximal end 16 and has an inner surface 21*a*. The fuse element 22 has a proximal end 22*a* and a distal end 22*b*, the fuse element is constructed and arranged with a number of weak spots 100. Each of the weak spots 100 has an effective length less than 0.018 inches. The fuse element 22 has a plurality of bends 101. The bends are constructed and arranged between a plurality of the weak spots in order to fit a longer fuse element within the confines of the tube 15**.

An electrically insulating end washer 25 having a proximal side **25*a*. The end washer 25 is constructed and arranged to fit within said inner surface 17 of the tube 15. The end washer 25 has a hole 27 to allow the insertion of loose sand filler into said tube. The end washer has a further aperture 26. The aperture 26 is constructed and arranged to secure said proximal end 22*a* of fuse element 22. The aperture 26 also allows a portion of the fuse element 22 to be exposed on the proximal side 25*a* of the end washer 25. The electrically conducting cap washer 28 is constructed and arranged to seat against the proximal end 16 of tube 15 and the end washer 25. The cap washer 28 also is constructed and arranged to fit within the proximal endcap 21 in order to electrically connect the proximal end 22*a* of said fuse element to the inner surface 21 of the proximal endcap 21 when endcap 21 is placed around the tube proximal end 16**.

The trigger assembly 70 has a proximal end 73 and a distal end 74.

A heater strip 50 is electrically connected to the inner surface of the distal endcap 31. The heater strip 50 has at least one flange 51 extending along the inner surface of said tube away from said distal end of said tube.

The electrically insulating spacer 40 having a proximal end 41*a* and a distal end 41*b*. The spacer has a spacer head 41 at the proximal end 41*a*. The spacer head 41 has an outside diameter approximately equal to the inner surface diameter of the tube. The spacer 40 has a spacer body 42. The spacer body has an outside diameter less than the outside diameter of the spacer head. The spacer 40 also has a hollow center 43 from its proximal end 41*a* to its distal end 41*b*.

The trigger body 72 has a proximal end 72*a* and a distal end 72*b*, the trigger head 71 is at the distal end 72*b*. The trigger head 71 is constructed and arranged to contact the flange 51 of said heater strip and constructed to be guided by the guide flange 51 when the head 71 is moved relative thereto. The trigger body 72 is constructed and arranged to fit within said hollow center 43.

The electrically conducting washer 90 has a proximal side 90*a* and a distal side 90*b* which seats against said proximal side 41*a* of the spacer. The distal side 90*b* of the washer further engages the proximal end 72*a* of the trigger body 72, the proximal end 90*a* of the washer is electrically connected to the distal end 22*b* of said fuse element.

The fusing alloy 80 physically and electrically connects the trigger to the heater strip and electrically connects the trigger to the washer 90. The fusing alloy 80 melts when heated to a prescribed temperature. When the alloy melts, the spring to force the trigger proximal end 72*a* away from the washer with the trigger head 71 being moved toward the tube distal end 18 along the guide flange 51 to interrupt the electric circuit.

I claim:

1. A fuse comprising:

a hollow tube having an inner surface, said tube further having a proximal end and a distal end;

a distal endcap covering said distal end of sad tube, said distal endcap having an inner surface;

a proximal endcap covering the proximal end of said tube, said proximal endcap having an inner surface;

a fuse element, said fuse element being a non-cylindrical fuse link with a proximal end and a distal end, said fuse element constructed and arranged with a number of weak spots, said number of said weak spots being greater than the product of the rms voltage rating of said fuse and 0.01, said fuse link having a plurality of bends between said weak spots;

means for electrically connecting said proximal end of said fuse element to said inner surface of said proximal endcap;

means for triggering an interrupting of the electric current during an overload condition and electrically connecting said distal end of said fuse element with said inner surface of said distal endcap; and a loose sand filler, said filler being positioned around said fuse element to ensure fast and reliable clearing of the fuse during a short circuit event.

2. A fuse as described in claim 1 wherein each of said weak spots in said fuse element has an effective length less than 0.018 inches.

3. A fuse as described in claim 1 wherein said fuse element has a plurality of bends, said bends forming an angle approximately equal to 90 degrees, said bends being constructed and arranged between a plurality of said weak spots of said fuse element in order to fit a longer fuse element within he confines of said tube.

4. A fuse as described in claim 1 wherein said proximal endcap and said distal endcap are capable of conducting electricity.

5. A fuse as described in claim 1 wherein means for electrically connecting said proximal end of said fuse element to said inner surface of said proximal endcap comprises:

an electrically insulating end washer having a proximal side, said end washer constructed and arranged to fit within said inner surface of said tube, said end washer having a hole to allow the insertion of loose sand filler into said tube, said end washer further having an aperture, said aperture constructed and arranged to secure said proximal end of said fuse element, said aperture also allowing a portion of said fuse element to be exposed on the proximal side of said end washer in order to enable said fuse element to electrically connect with said inner surface of said proximal endcap.

6. A fuse described in claim 5 wherein said means for electrically connecting said proximal end of said fuse element to said inner surface of said proximal endcap further comprises:

an electrically conducting cap washer, said cap washer constructed and arranged to seat against the proximal end of said tube and said end washer, said cap washer also constructed and arranged to fit within said proximal endcap in order to electrically connect said proximal end of said fuse element to said inner surface of said proximal endcap when said endcap is placed around said proximal end of said tube.

7. A fuse as described in claim wherein said means for triggering interruption of the electric current during an overload condition and electrically connecting said distal end of said fuse element with said inner surface of said distal endcap is a trigger assembly having a proximal end and a distal end comprising:

a heater strip electrically connected to said inner surface of said distal endcap, said heater strip having at least one flange extending along said inner surface of said tube away from said distal end of said tube;

an electrically insulating spacer having a proximal end and a distal end, said spacer having a spacer head at said proximal end, said spacer head having an outside diameter approximately equal to the inner surface diameter of said tube, said spacer having a spacer body, said spacer body having an outside diameter less than the outside diameter of said spacer head, said spacer also having a hollow center from said proximal end to said distal end;

a trigger, said trigger having a proximal end and a distal end, said trigger having a trigger head at said distal end, said trigger head constructed and arranged to contact said flange of said heater strip, said trigger further having a trigger body, said trigger body constructed and arranged to fit within said hollow center of said spacer, said trigger body further constructed to be the same length as said spacer;

an electrically conducting washer, said washer having a proximal side and a distal side, said washer constructed and arranged so that said distal side of said washer seats against said proximal side of said spacer, said distal side of said washer further engaging said proximal end of said trigger, said proximal end of said washer being electrically connected to the distal end of said fuse element;

a spring constructed and arranged to fit between the trigger head and the spacer head;

a fusing alloy, said fusing alloy physically and electrically connecting said trigger to said heater strip, said fusing alloy also physically and electrically connecting said trigger to said washer, said fusing alloy constructed and arranged to melt when heated to a prescribed temperature thereby allowing said spring to force said trigger away from said washer and interrupt the electric circuit.

8. A fuse as described in claim 7 wherein said fusing alloy is constructed of 42% Tin (Sn) and 58% Bismuth, said alloy having a melting point of 138 degrees celsius.

9. A fuse as described in claim 7 wherein said washer is constructed of brass.

10. The fuse of claim 1 wherein said fuse element is a flat strip.

11. The fuse of claim 2 wherein said fuse element is a flat strip.

12. The fuse of claim 5 wherein said fuse element is a flat strip.

13. The fuse of claim 6 wherein said fuse element is a flat strip.

14. The fuse of claim 7 wherein said fuse element is a flat strip.

15. The fuse of claim 8 wherein said fuse element is a flat strip.

* * * * *